United States Patent [19]

Oh

[11] Patent Number: 4,899,026

[45] Date of Patent: Feb. 6, 1990

[54] AUTOMATIC COOKING CONTROL SYSTEM FOR A MICROWAVE OVEN

[75] Inventor: Ki Tae Oh, Kyungsangnam, Rep. of Korea

[73] Assignee: Goldstar Co., Ltd., Seoul, Rep. of Korea

[21] Appl. No.: 287,020

[22] Filed: Dec. 21, 1988

[30] Foreign Application Priority Data

Dec. 22, 1987 [KR] Rep. of Korea ..... 14744/1987

[51] Int. Cl.[4] ..... H05B 6/68

[52] U.S. Cl. ..... 219/10.55 M; 219/10.55 B; 99/325

[58] Field of Search ..... 219/10.55 B, 10.55 R, 219/10.55 E, 10.55 M, 492, 400; 99/325, DIG. 14; 426/243

[56] References Cited

U.S. PATENT DOCUMENTS

| | | | |
|---|---|---|---|
| 4,115,678 | 9/1978 | Tachikawa et al. | 219/10.55 B |
| 4,162,381 | 7/1979 | Buck | 219/10.55 B |
| 4,812,606 | 3/1989 | Eke | 219/10.55 B |
| 4,831,227 | 5/1989 | Eke | 219/10.55 M |

*Primary Examiner*—Philip H. Leung

*Attorney, Agent, or Firm*—Birch, Stewart, Kolasch & Birch

[57] ABSTRACT

An automatic cooking control system for a microwave oven which utilizes an initial operation process that shifts a temperature of inflow air stored in memories to other memories and repeatedly stores a present inflow air temperature in another memory until the present detected inflow air temperature is equal to the temperature stored in the memory. This initial process also determines a temperature variation in the inflow air and a temperature difference between the air flowing in and out. A temperature compensating portion is obtained from the temperature variation and difference, which is used to establish a temperature increment by dividing the temperature compensating portion into a predetermined temperature increment. The microwave oven then utilizes a first stage heating process until the temprature of the air flowing from a heating chamber is raised as much as the compensated temperature increment. When this condition is realized, a second stage heating process is carried out for the time of the first stage heating time multiplied by a predetermined value according to the kind of food being cooked.

16 Claims, 3 Drawing Sheets

FIG, 1
PRIOR ART
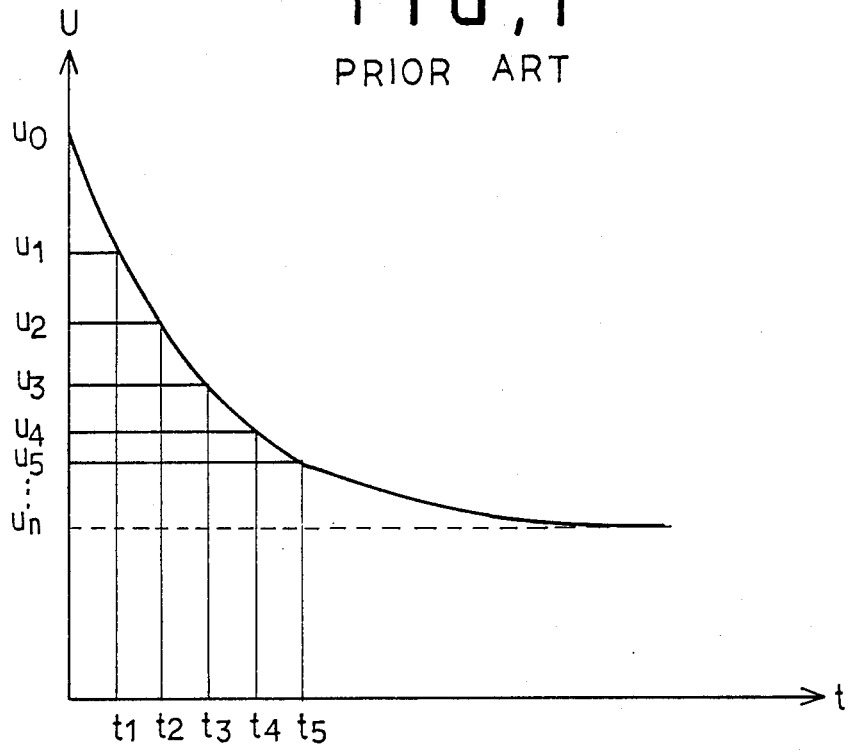
FIG, 2
PRIOR ART
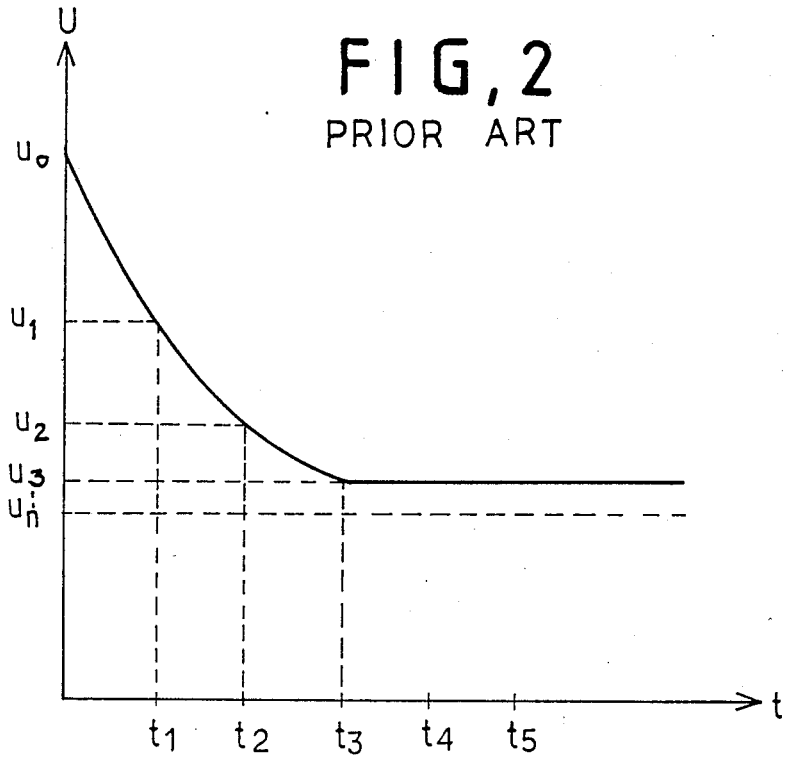

FIG,3
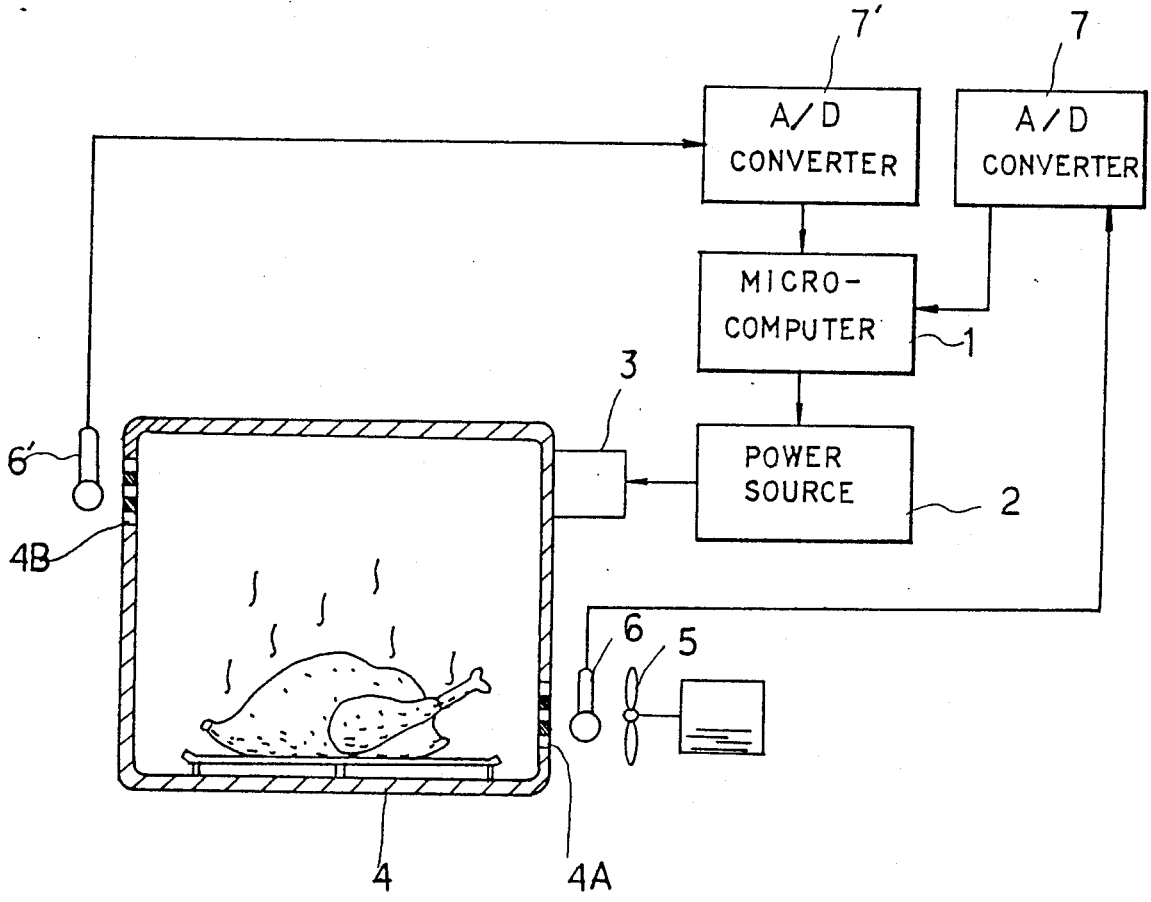

AUTOMATIC COOKING CONTROL SYSTEM FOR A MICROWAVE OVEN

BACKGROUND OF THE INVENTION

The present invention relates to an automatic cooking control system for a microwave oven which can automatically cook a food contained in heating chamber by utilizing temperature detecting sensors. More specifically the invention relates to an improvement of U.S. patent application, Ser. No. 07/256,964, filed on Oct. 13, 1988, Titled "Automatic Cooking Control System for a Microwave Oven".

According to the conventional system, food contained in a heating chamber is cooked using a method having the steps: detecting the inflow air temperature at the beginning of air flow into a heating chamber; detecting the inflow air temperature at about a ten second period; comparing the present temperature with the temperature detected immediately before; obtaining, if the compared temperatures are equal, the temperature variance of the inflow air by subtracting the inflow air temperature detected at the beginning of actuating a fan from the present inflow air temperature; obtaining the temperature difference between the air flowing in and out by subtracting the present inflow air temperature from the present temperature of the outflow air flowing out of the heating chamber; calculating the temperature increment using the temperature variance of the inflow air and the temperature difference between the flowing out and in air; thereafter executing a first stage heating process by actuating a magnetron until the temperature of the air flowing out of the heating chamber is raised as much as the temperature increment calculated; and executing a second stage heating process for a time period equal to a predetermined constant is multiplied by the first stage heating time. In such a cooking system, there are disadvantages in that the temperature variation and difference and the temperature increment are obtained and calculated when the temperature of the inflow air converges with exterior temperature within a range of 70–80% because the temperature of the inflow air is detected at 10 second intervals it is compared with the temperature of the inflow air detected immediately before, thereby the food occasionally is not cooked correctly. This also results from the resolution of an A/D converter which converts the signal of the temperature detected at a temperature sensor into a digital signal and input it to a microcomputer. The resolution of the A/D converter is generally about 0.5° C., and thus, any the temperature change below 0.5° C. is treated as zero.

Due to the resolution of the A/D converter, even when the temperature difference between the temperature of the inflow air detected at present and the temperature of the inflow air detected just before is substantial, the microcomputer determines that temperature difference is zero if the temperature difference is smaller than the resolution of the A/D converter. Assuming that, for example, the resolution of the A/D converter is 0.5° C., and there is a difference of 0.4° C. between the temperature $U_4$ of the inflow air detected at the time $t_4$ and the temperature $U_5$ of the inflow air detected at the time $t_5$, as shown in FIG. 1, the microcomputer determines is subject to that the two temperatures $U_4$ and $U_5$ are equal, and calculates the temperature variation, difference, and increment in a condition that the inflow air temperature U is converged with the exterior temperature $U_N$ and 70–80%, and then heats the food. It is also noted that the larger the time constant of the temperature sensors, the bigger the error described above.

The above problems can be substantially solved by extending the period for detecting the temperature of the inflow air. When the period for detecting the temperature U of the inflow air is doubled, the temperature variation and difference are determined when the temperature of the inflow air converges with the exterior temperature $U_N$ within a range of about 85–90%. This allows the temperature increment to be calculated so that the food can be more correctly heated. However, such an extension of the period for detecting the temperature U of the inflow air also results in the extension of time for calculating the temperature increment.

In other words, if the temperature difference between the temperatures $U_2$ and $U_3$ detected at the time $t_2$ and $t_3$ is 0.4° C., as shown in FIG. 2, the microcomputer calculates the temperature increment at the time $t_3$, but if the temperature difference between the temperatures $U_2$ and $U_3$ is 0.5° C., the microcomputer calculates the temperature increment after waiting until at time $t_4$, and then the food is heated, thereby the initial operation is unnecessarily extended.

As a result, if the detecting period is extended, the reliability of the cooking is promoted, while the time for calculating the temperature increment is also increased.

SUMMARY OF THE INVENTION

Therefore, the object of the present invention is to provide an automatic cooking control system which is able to improve the reliability of the automatic cooking of food without extending the time required for calculating the temperature increment.

The above object of the present invention is attained by calculating the temperature increment by shortening the period for detecting the inflow air temperature and by lengthening the period for comparing the detected temperatures.

BRIEF DESCRIPTION OF THE DRAWINGS

FIG. 1 and FIG. 2 are graphs for explaining the conventional art cooking control system;

FIG. 3 is a schematic diagram illustrating the configuration of a microwave oven of the present invention.

DETAILED DESCRIPTION OF THE INVENTION

Figure 4:
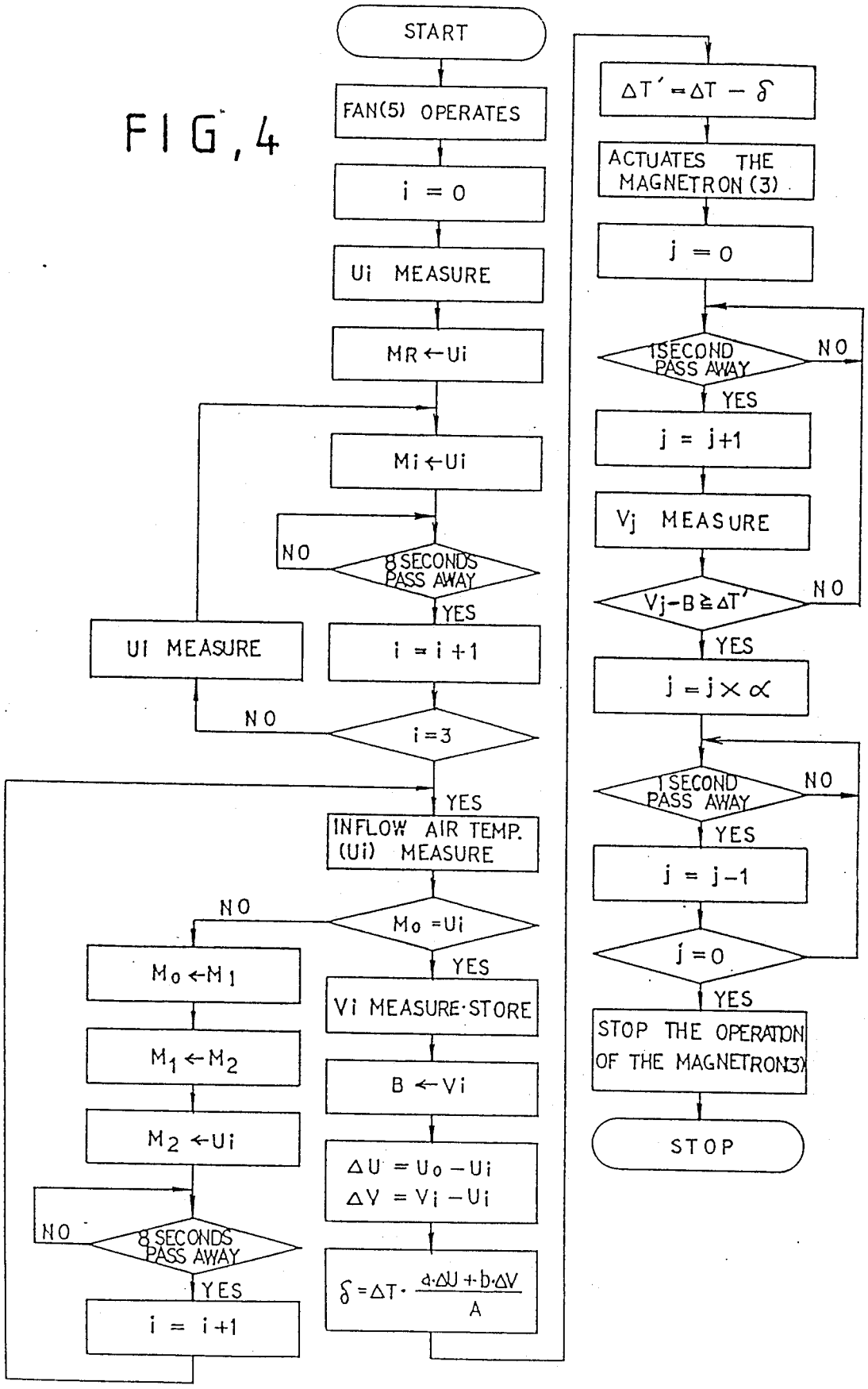
FIG. 4 is a flow chart of the microcomputer of FIG. 3.

Referring to FIG. 3, a microwave oven according to the present invention comprises a microcomputer 1 which controls the whole operation of a microwave oven, a power source 2 which supplies an operational electric power under the control of the microcomputer 1, a magnetron 3 which generates microwave energy upon actuation by electric power from the power source 2, a heating chamber 4 which heats the food with the microwave energy generated by the magnetron 3, a fan 5 which blows air through an air inlet 4A into the heating chamber 4, temperature sensors 6 and 6' which detect the temperatures of the air flowing in and out of the heating chamber 4 are mounted respectively at the air inlet 4A and air outlet 4B of the heating chamber 4, and analog/digital converters 7 and 7' which convert respectively the signals of air temperature detected at the temperature sensors 6 and 6' into digital signals and input them to the 1.

Using the present invention as constructed above, when food to be cooked is put in a heating chamber 4 and automatic cooking is started by pressing a cooking start button, as shown in FIG. 4. A fan 5 is actuated by a microcomputer 1 to blow air into the heating chamber 4 through an air inlet 4A. After a variable i is set to zero, air temperature $U_0$ of the air being blown through the air inlet 4A is measured and stored in memories MR and $M_1$. The temperature $U_0$ of the initial inflow air, which is detected by the temperature sensor 6 at the initial time of the automatic cooking cycle, is converted into a digital signal by the analog/digital converter 7 and stored in memories MR and $M_0$. When eight seconds have elapsed, 1 is added to the variable i and the temperature $U_i$ of inflow air is measured again and stored in a memory $M_i$. This is repeated every light seconds. The temperature $U_i$ of inflow air is measured every eight seconds of constant period and stored in the memories $M_0$, $M_1$, $M_2$ . . . . When the variable i becomes 3, the temperature $U_i$ of inflow air is measured and it is compared with the temperature stored in a memory $M_0$. At this moment, if the temperature $U_i$ of inflow air is not identical to the temperature stored in the memory $M_0$, the temperature stored in the memories $M_1$ and $M_w$ is shifted to the memories $M_0$ and $M_1$ and the temperature $U_i$ just measured is stored in the memory $M_2$. After eight seconds have elapsed, 1 is added to the variable i and the temperature of inflow air is measured again and compared with the temperature stored in the memory $M_0$.

The above process is repeated until the present temperature $U_i$ of inflow air is equal to the temperature stored in the memory $M_0$.

In such a state, when the present temperature $U_i$ is equal to the temperature stored in the memory $M_0$, the outflow air temperature $V_i$ is detected by the temperature sensor 6' mounted at the outlet 4B, converted into a digital signal by the analog/digital converter 7', and stored in a register B. The temperature variation $\Delta U$ $\Delta$ is calculated by subtracting the present temperature $U_i$ of inflow air from the initial temperature $U_0$ of inflow air stored in the memory MR and the temperature difference $\Delta V$ is calculated by subtracting the inflow air temperature $U_i$ from the present outflow air temperature $V_i$. Thus, when the temperature variation $\Delta U$ and the temperature difference $\Delta V$ are obtained, the experimentally sought additional values a and b are respectively multiplied by the temperature variation $\Delta U$ and temperature difference $\Delta V$ via a the microcomputer 1. The values are added together and multiplied by a temperature increment $\Delta T$ in accordance with the kind of food to be cooked. A temperature increment compensating portion $\delta$ is found by dividing the product by an experimental coefficient A. Thereafter, a compensated temperature increment $\Delta T'$ is found by subtracting the temperature increment compensating portion $\delta$ from the temperature increment $\Delta T$.

Thus, when the compensated temperature increment $\Delta T'$ is found, food is heated by actuating a magnetron 3 via the microcomputer 1. After a variable j is set to zero, 1 is added to the variable j for every second that has elapsed. Every second an air temperature $V_j$ flowing out through an air outlet 4B of a heating chamber 4 is measured. Whether or not the present outflow air temperature $V_j$ is more than a compensated temperature increment $\Delta T'$ is also determined every second An outflow air temperature $V_i$ stored at the register B is subtracted from the present outflow air temperature $V_j$ and the above operation is repeated until said subtracted value is increased more than a compensated temperature increment $\Delta T'$. When the outflow air temperature $V_j$ is more than the compensated temperature increment $\Delta T'$, a second stage heating operation is begun.

Thus, when the first stage heating operation and the second stage heating operation are completed, the automatic cooking of the food is complete.

On the other hand, in the above description, the inflow air temperature $U_i$ has been measured every 8 seconds, and the measured present temperature has been compared with a temperature stored in memory measured 24 seconds before, however, in practicing the present invention, the period for detecting the inflow air temperature $U_i$ and the period for comparing the inflow air temperature $U_i$ can be varied according to the capacity of memory.

The present invention, as described above, provides an automatic cooking which can set correctly and quickly the temperature increment by shortening the period for detecting the inflow air temperature and by lengthening the period for comparing the detected temperatures, thereby the reliability of automatically cooking food can be improved.

What is claimed is:

1. A method of automatically cooking food in a microwave oven having a heating chamber and a magnetron, comprising the steps of:

(a) measuring an initial temperature of air flowing into the heating chamber;

(b) storing the initial temperature as a first reference value and a first temperature;

(c) delaying eight seconds;

(d) measuring and storing a temperature of the air flowing into the heating chamber;

(e) repeating said steps (c) and (d) until a second and third temperature is measured and stored;

(f) measuring a fourth temperature of the air flowing into the heating chamber;

(g) determining if the fourth temperature is equal to the first temperature;

(h) measuring and storing a temperature of air flowing out of the heating chamber as a second reference value when said step (g) has determined that the fourth temperature is equal to the first temperature;

(i) calculating a temperature increment value by using the first reference value, fourth temperature, and the temperature of the air flowing out of the heating chamber;

(j) actuating the magnetron for a first time period;

(k) measuring the temperature of the air flowing out of the heating chamber;

(l) determining if a difference between the temperature measured in said step (k) and the second reference value is greater than or equal to the temperature increment value; and (m) actuating the magnetron for a second time period when said step (l) has determined that the difference is greater than or equal to the temperature increment value, thereby automatically cooking food.

2. The method as claimed in claim 1, wherein said step (b) stores the initial temperature in a first memory location of the microwave oven, the first memory location representing the first temperature.

3. The method as claimed in claim 2, wherein said step (d) stores the temperatures in a second and third memory locations of the microwave oven.

4. The method as claimed in claim 3, further comprising the steps of:

(n) shifting contents of the second memory location into the first memory location when said step (g) determines that the fourth temperature is not equal to the first temperature;

(o) shifting contents of the third memory location into the second memory location when said step (n) is completed;

(p) storing the fourth temperature in the third memory location when said step (o) is completed;

(q) delaying for eight seconds; and (r) repeating said step (f) and (g).

5. The method as claimed in claim 1, wherein said step (i) comprises the steps of:

(n) calculating a first temperature difference by subtracting the fourth temperature from the first reference value;

(o) calculating a second temperature difference by subtracting the fourth temperature from the temperature measured in said step (h);

(p) calculating a temperature increment compensation value from the differences calculated in said steps (n) and (o); and (q) calculating the temperature increment value by subtracting the temperature increment compensation value from a predetermined temperature increment value.

6. The method as claimed in claim 1, wherein said step (k) is executed every second.

7. The method as claimed in claim 1, wherein the second time period is equal to the first time period multiplied by a predetermined coefficient value.

8. The method as claimed in claim 1, further comprising the step of:

(n) repeating steps (k) and (l) when said step (l) has determined that the difference is less than the temperature increment value.

9. The method as claimed in claim 1, further comprising the step of:

(n) actuating a fan of the microwave oven prior the execution of said step (a).

10. A method of automatically cooking food in a microwave oven having a heating chamber and a magnetron, comprising the steps of:

(a) measuring and storing four temperature values of air flowing into the heating chamber, each temperature value being measured eight seconds apart;

(b) determining if the first temperature value is equal to the fourth temperature value;

(c) measuring and storing a temperature of air flowing out of the heating chamber as a reference value when said step (b) determines that the first temperature value equals the fourth temperature value;

(d) calculating a temperature increment value;

(e) actuating the magnetron for a first period of time;

(f) measuring the temperature of air flowing out of the heating chamber;

(g) determining if a difference between the temperature measured in said step (f) and the reference value is greater than or equal to the temperature increment value; and (h) actuating the magnetron for a second period of time when said step (g) has determined that the difference is greater than or equal to the reference value.

11. The method as claimed in claim 10, wherein said step (a) comprises the steps of:

(i) measuring an initial temperature of air flowing into the heating chamber;

(j) storing the initial temperature as an initial value and a first temperature;

(k) delaying eight seconds;

(l) measuring and storing a temperature of the air flowing into the heating chamber;

(m) repeating said steps (k) and (l) until a second and third temperature is measured and stored; and (n) measuring a fourth temperature of the air flowing into the heating chamber.

12. The method as claimed in claim 10, wherein said step (d) comprises the steps of;

(i) calculating a first temperature difference by subtracting the fourth temperature from the initial value;

(j) calculating a second temperature difference by subtracting the fourth temperature from the temperature measured in said step (c);

(k) calculating a temperature increment compensation value from the difference calculated in said steps (i) and (j); and (l) calculating the temperature increment value by subtracting the temperature increment compensation value from a predetermined temperature increment value.

13. The method as claimed in claim 10, wherein said step (f) is executed every second.

14. The method as claimed in claim 10, wherein the second period of time is equal to the first period of time multiplied by a predetermined coefficient value.

15. The method as claimed in claim 10, further comprising the step of:

(i) repeating steps (f) and (g) when said step (g) has determined that the difference is less than the temperature increment value.

16. The method as claimed in claim 10, further comprising the step of:

(i) actuating a fan of the microwave oven prior to the execution of said step (a).

* * * * *